US009021722B2

(12) United States Patent
Kasprzak

(10) Patent No.: US 9,021,722 B2
(45) **Date of Patent: *May 5, 2015**

(54) SOLE FOR A GOLF SHOE

(71) Applicant: ECCO Sko A/S, Bredebro (DK)

(72) Inventor: Dieter Kasprzak, Bredebro (DK)

(73) Assignee: ECCO Sko A/S, Bredebro (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/867,288

(22) Filed: Apr. 22, 2013

(65) Prior Publication Data

US 2013/0232823 A1 Sep. 12, 2013

Related U.S. Application Data

(60) Division of application No. 13/357,131, filed on Jan. 24, 2012, which is a continuation of application No. 12/874,285, filed on Sep. 2, 2010, now Pat. No. 8,490,303.

(30) Foreign Application Priority Data

Apr. 14, 2010 (EP) ..... 001695073
Apr. 16, 2010 (EP) ..... 001696550

(51) Int. Cl.
*A43B 5/00* (2006.01)
*A43B 13/22* (2006.01)

(52) U.S. Cl.
CPC ..... *A43B 5/001* (2013.01); *A43B 13/223* (2013.01)

(58) Field of Classification Search
CPC ..... A42B 5/001; A42B 13/223
USPC ..... 36/127, 67 A, 126, 128, 129, 134, 67 R, 36/67, 59 R, 59 C, 67 D; D2/954–959
See application file for complete search history.

(56) References Cited

U.S. PATENT DOCUMENTS

| | | | | | |
|---|---|---|---|---|---|
| 3,988,840 | A | * | 11/1976 | Minihane | 36/32 R |
| 4,085,527 | A | * | 4/1978 | Riggs | 36/114 |
| 4,327,503 | A | * | 5/1982 | Johnson | 36/32 R |
| D266,966 | S | * | 11/1982 | Inohara | D2/908 |
| 4,378,643 | A | * | 4/1983 | Johnson | 36/129 |
| 4,402,145 | A | * | 9/1983 | Dassler | 36/32 R |
| 4,590,693 | A | * | 5/1986 | Kawashima et al. | 36/126 |
| 4,782,604 | A | * | 11/1988 | Wen-Shown | 36/127 |
| D440,032 | S | * | 4/2001 | Madden | D2/954 |
| D467,061 | S | * | 12/2002 | Della Valle | D2/954 |
| D468,517 | S | * | 1/2003 | Recchi et al. | D2/954 |
| D474,879 | S | * | 5/2003 | Nason | D2/955 |
| D481,201 | S | * | 10/2003 | Shea et al. | D2/954 |
| D500,190 | S | * | 12/2004 | Della Valle | D2/954 |
| D509,950 | S | * | 9/2005 | Adams et al. | D2/959 |
| 7,146,752 | B2 | * | 12/2006 | Pasternak et al. | 36/59 R |
| D560,888 | S | * | 2/2008 | Della Valle | D2/954 |
| D597,735 | S | * | 8/2009 | Norton | D2/957 |
| D599,990 | S | * | 9/2009 | Belley et al. | D2/952 |
| D619,345 | S | * | 7/2010 | Favreau et al. | D2/957 |
| D646,050 | S | * | 10/2011 | Norton | D2/957 |
| 2008/0201992 | A1 | * | 8/2008 | Avar et al. | 36/25 R |
| 2011/0247243 | A1 | | 10/2011 | Eder et al. | |

* cited by examiner

*Primary Examiner* — Ted Kavanaugh
(74) *Attorney, Agent, or Firm* — McCormick, Paulding & Huber LLP

(57) ABSTRACT

An outer sole for a golf shoe includes a plurality of cleats distributed along a forefoot area and a heel area. The cleats are integrated with the outer sole and extend from a surface of the outer sole that faces away from the shoe. The plurality of cleats includes at least a larger sized set of cleats and a smaller sized set of cleats. Such outer sole for a golf shoe gives good traction on the golf course but is also useable as a casual shoe off the golf course.

19 Claims, 3 Drawing Sheets

SOLE FOR A GOLF SHOE

CROSS REFERENCE TO RELATED APPLICATIONS

This application is a divisional application of U.S. application Ser. No. 13/357,131, filed on Jan. 24, 2012, which is a continuation application of U.S. application Ser. No. 12/874,285, filed on Sep. 2, 2010, which is entitled to the benefit of European Design registration Nos. 001695073-001, filed Apr. 14, 2010, and 001696550-0026, filed Apr. 16, 2010, each of which is hereby incorporated by reference in its entirety. U.S. application Ser. No. 12/874,285 also incorporates by reference essential subject matter disclosed in a U.S. Design Application No. 29/370,153, filed Jun. 11, 2010, which is hereby also incorporated by reference in its entirety.

BACKGROUND OF THE INVENTION

1. Field of the Invention

The present invention relates to golf shoes and, more particularly, to a sole therefor.

2. Description of the Related Art

A golfer needs a strong grip or traction between a golf shoe and the green. The traction is particularly important during a golf swing. Existing golf shoes generally include protrusions on an outer sole to achieve the grip. The protrusions are typically called studs, spikes or cleats. In the following the word cleat will be used. Some golf shoes have soles with a receptacle into which the cleat is screwed. The cleat is thus removable and replaceable. Other golf shoes have the cleats integrally molded with the sole. An example of an athletic shoe with integrally molded cleats is described in U.S. Pat. No. 4,327,503.

A major problem with golf shoes with cleats is that the cleats can leave cleat marks (or holes) on a grass surface of a golf course, particularly on a putting green, therefore, damaging the green. A careless golfer who shuffles or twists his feet while walking across the putting green can damage the grass surface. Even a careful golfer can leave cleat marks on the putting green, particularly when the putting green is wet. Some golf clubs even ban golf shoes with steel cleats from the golf course because this type of cleats has long nails that damage the green. In order to avoid such damage but still have a firm grip, a special type of "soft cleats" or "soft spikes" has been developed during recent years. These cleats comprise between four and six resilient arms extending from a base; the arms resiliently dig into the green and create at the same time sufficient grip. A drawback is, however, that once the golf player leaves the course, the arms, which are typically made from plastic, are immediately exposed to wear and tear from e.g. the asphalt of the street. Use outside the golf course rapidly wears down the plastic arms, and the cleat has to be replaced with a new one.

Another problem with golf shoes with cleats is that the shoes tend to accumulate dirt and debris, especially during wet conditions. The accumulation of such dirt and debris requires frequent and tedious cleaning to provide the desired grip during the golf swing.

SUMMARY OF THE INVENTION

One object of the invention is to create a sole for use in a golf shoe which ensures a satisfactory grip without damaging the golf course. A further objective is to make a golf sole which is versatile and comfortable and can be used both inside and outside the golf course.

According to the present invention, a golf shoe includes an outer sole having a plurality of cleats distributed along a forefoot and a heel area. The cleats are disposed on and extend away from an outer surface of the outer sole. The cleats are essentially cross-shaped with a central circle to minimize sharp internal corners.

The forefoot of the outer sole has more cleats per area unit (e.g. per square inch) than the heel area of the outer sole. The forefoot includes a ball area and a toe area. The ball area and the heel area have cleats with greater heights and widths than other areas of the sole. The cleats along the ball area and the heel area are substantially equal in height. The cleats are arranged in transverse rows along a longitudinal length of the outer sole.

DESCRIPTION OF THE PREFERRED EMBODIMENTS

Figure 1:
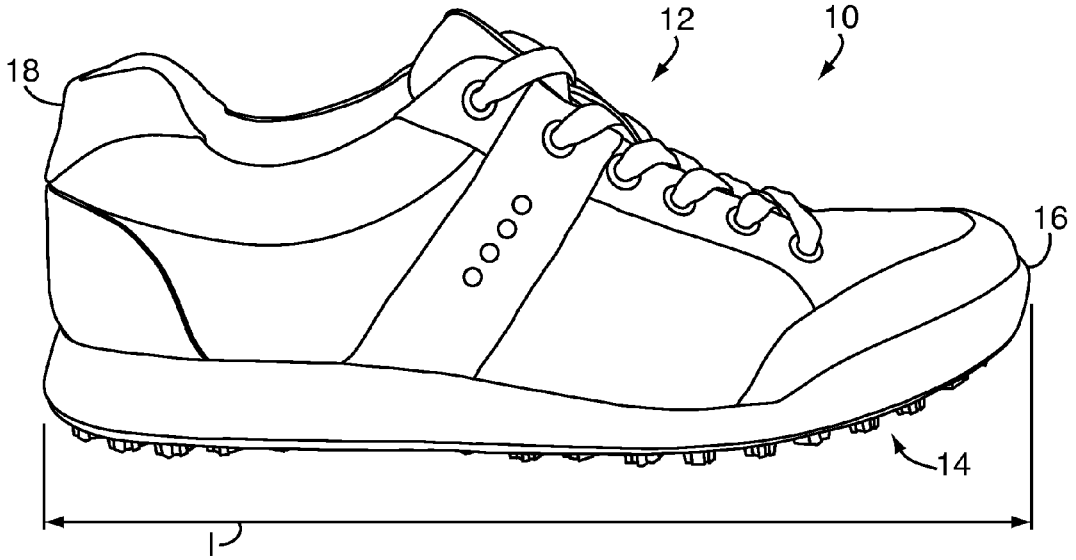
FIG. 1 is a side view of a golf shoe according to the present invention.
Figure 2:
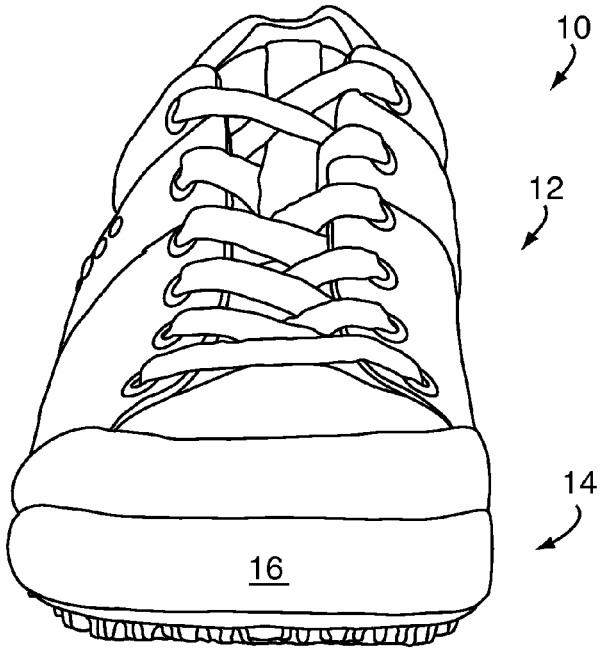
FIG. 2 is a front view of the golf shoe of FIG. 1.
Figure 3:
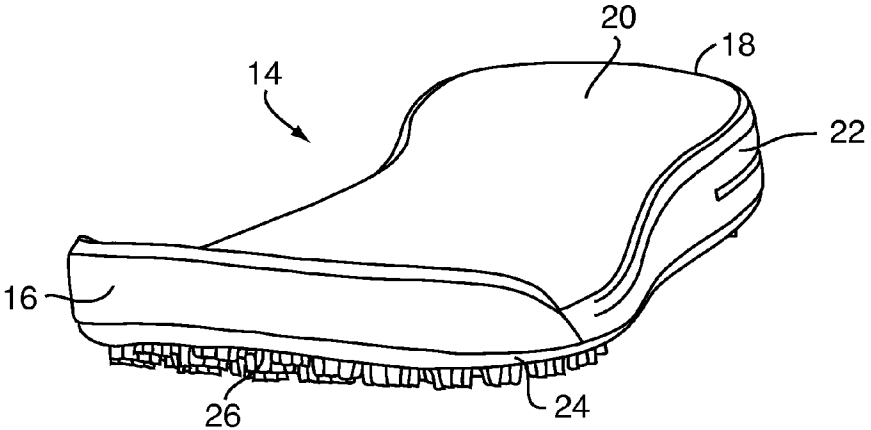
FIG. 3 is a perspective view of a sole of the golf shoe of FIGS. 1-2.

Referring to FIGS. 1 and 2, a golf shoe 10 includes an upper 12 and a sole 14 extending from a toe end 16 to a heel end 18 and having a longitudinal length 'l'. Referring to FIG. 3, the sole 14 has a foot bed 20, a mid-sole 22, and an outer sole 24. The foot bed 20 is the top portion of the sole 14 that is adjacent to the wearer's foot. Typically, in use, an inlay sole (not shown) will be placed on top of the foot bed 20. The mid-sole 22 is the portion of the sole sandwiched between the foot bed 20 and the outer sole 24. The mid-sole 22 is a reinforcing longitudinal element and may include a shank (not shown) to provide additional torsional stability to the sole 14.

The outer sole 24 is the bottom portion of the sole 14 that is located below the mid-sole 22 and comes into contact with the ground. The outer sole 24 may have a thickness of between about 0.098 inch (2.5 mm) and about 0.118 inch (3 mm). The outer sole 24 has an outer surface 26 that extends across the bottom of the outer sole 24.

Figure 4:
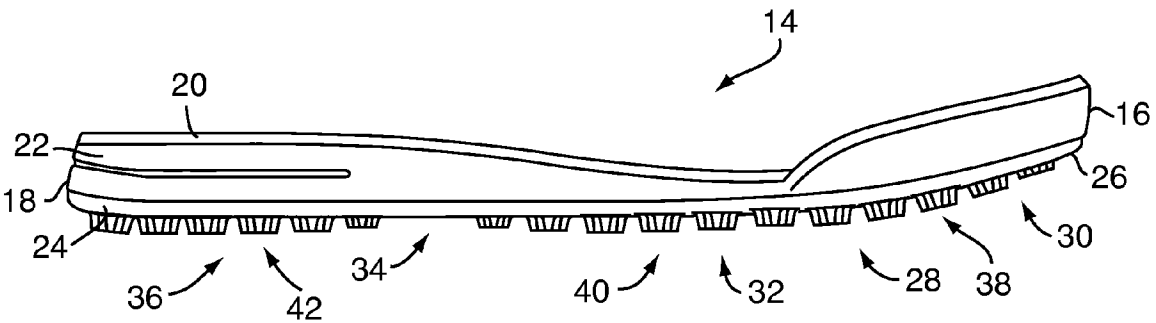
FIG. 4 is a side view of the sole of the golf shoe of FIG. 1.

Referring to FIG. 4, the sole 14 is divided into a forefoot 28, which includes a toe area 30 and a ball area 32, a mid-foot area 34, and a heel area 36. The outer sole 24 is substantially flat or horizontal, from the heel area 36 to the ball area 32. The outer sole 24 includes a curvature 38 along the toe area 30.

Figure 5:
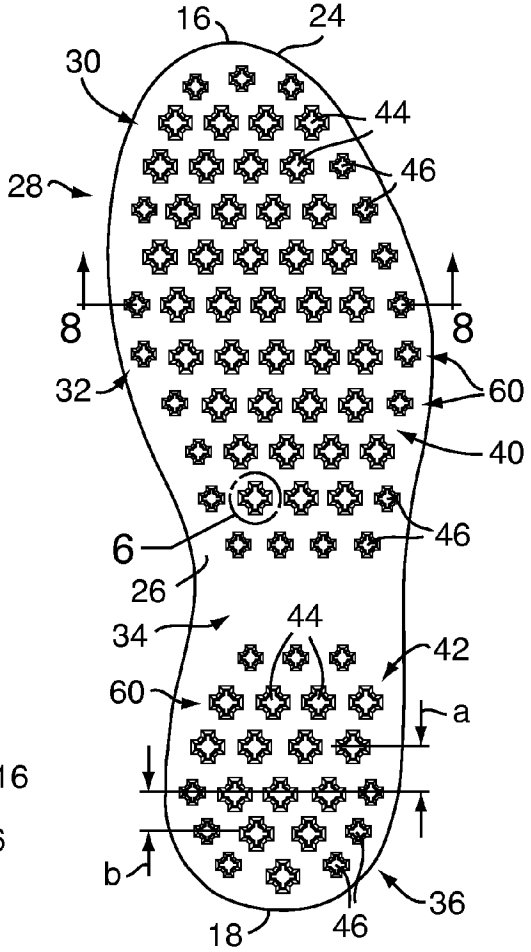
FIG. 5 is a bottom view of the sole of the golf shoe of FIGS. 1-3, with a plurality of cleats.

Referring to FIG. 5, the outer sole 24 includes a first plurality of cleats 40 distributed along the forefoot 28 and a second plurality of cleats 42 distributed along the heel area 36. Each of the plurality of cleats 40, 42 includes a larger sized set of cleats 44 that are substantially encircled by a smaller sized set of cleats 46. The cleats 44, 46 are disposed on the outer surface 26 and extend downward therefrom. In an embodiment shown, the outer sole 24 has thirty-eight (38) of the larger cleats 44 substantially encircled by twenty (20) of the smaller cleats 46 in the ball area 32, and fourteen (14) of the larger cleats 44 substantially encircled by nine (9) of the smaller cleats 46 in the heel area 36. The total area of bottom surfaces 56, shown in FIGS. 6 and 7, covered by the cleats is approximately 33% of the full outer surface 26 or also referred to as an outsole area. The preferred area coverage of the cleats lies in the range 25% to 40% of the outsole area 26. Cleat density is defined as a ratio of the number of cleats multiplied by the area of the cleat bottom surface 56 and divided by the full area of the outsole 26 and is important when considering walking comfort. Few large area cleats give poor walking comfort, while many small area cleats give good comfort but low grip. A trade off is needed, and the inventors have found that a cleat density equal to or above 0.25 and equal to or below 0.60 gives a good compromise between grip and balanced weight distribution. The preferred range is equal to or above 0.25 and equal to or below 0.40. The number of cleats should be chosen from the range between 40 and 100. In the current embodiment, there are 81 cleats covering approximately ⅓ of the outsole 26 surface area. This gives a cleat density of approximately 0.33.

Figure 7:
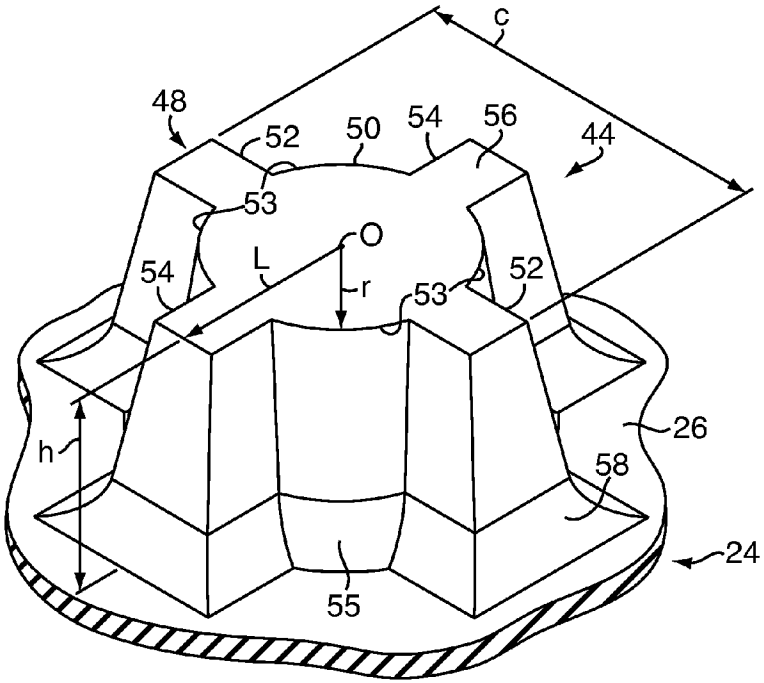
FIG. 7 is a perspective view of the cleat of FIG. 6.
Figure 8:
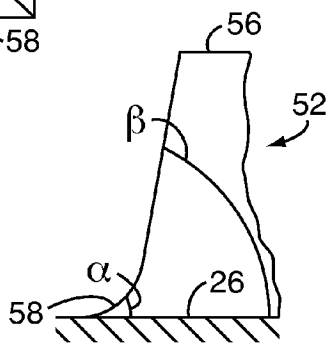
FIG. 8 is a partial cross sectional view of the cleat of FIG. 7.
Figure 6:
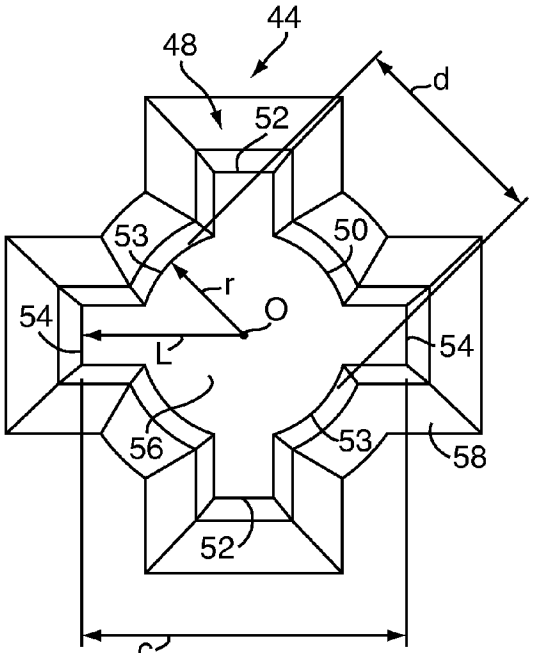
FIG. 6 is an enlarged view of one of the cleats of FIG. 5.

Referring to FIGS. 6 and 7, each cleat 44, 46 has a cross-sectional shape that is essentially cross-shaped. More specifically, the cross-sectional shape is a cross 48 interlaid with and extending from a circle 50 having a center point O. The cross-sectional shape of each cleat 44, 46 may also be described as a circle 50 having two pairs of diametrically opposed cross arms 52, 54 extending radially outward therefrom. The diametrically opposed cross arms 52, 54 are substantially perpendicular to each other. The arms are connected by arc sections 53, and the number of arc sections 53 corresponds to the number of arms 52, 54. In this embodiment, four (4) arc sections 53 and four (4) arms 52, 54 are shown. Although there could be a greater or lesser number of arms and arc sections, four arcs and four arms provide superior traction results. The four arc segments are substantially concentric, i.e. they have the same center O, which is the geometrical middle point of the cleat. The arc segments 53 thus have the same radius of curvature r (=d/2), which is smaller than the distance L (=c/2) from the end of a cross arm to the center. The radius r of the arc segments 53 can be decreased and increased; in the most extreme case it can be increased to the radius L corresponding to the length of the arms from their end to the center O. In this case the cleat would simply have the shape of a conical cylinder. Each cleat 44, 46 includes a base portion 55 extending from the outer surface 26 and terminating in a bottom surface 56 which comes into contact with the ground. Each cleat 44, 46 is tapered from the base surface 55 towards the bottom surface 56 such that the cross arm 52 has a larger width at the line where it meets the base surface 55 than at the bottom surface 56. Preferably, as shown in FIG. 8, there is a first inclination $\alpha$ of the base surface 55, and a second, steeper inclination $\beta$ of the arm 52. The base surface 55 has the first inclination $\alpha$ of between 15 and 40 degrees with the horizontal plane defined as the outer surface 26, while the arm 52 has the second inclination $\beta$ between 60 and 85 degrees with the horizontal plane or outer surface 26. A fillet radius 58 joins the cross 48 and the circle 50 with the outer surface 26 in the base portion of each cleat 44, 46. As a result, the cross-section of each cleat 44, 46 decreases from the base portion 55 to the bottom surface 56. Because the cleat is integrally molded with the outsole, this gives a firm attachment and good stability especially during the golf swing; such firm attachment would not be obtained if the cleat was not integrally molded with the sole, but instead attached via a thread to a receptacle mounted in the sole. The firm grip is further enhanced through the tapering of the cleat.

Each cross arm 52, 54 defines a cross arm length 'c' measured from one end of one of the arms to the other end of the corresponding arm. The cross arm lengths 'c' of each cross arm 52, 54 are substantially equal. The different sets of cleats 44, 46 have different cross arm lengths 'c', as for example 0.276 inch (7 mm) and 0.374 inch (9.5 mm). The different sets of cleats 44, 46 are substantially equally scaled by proportionally enlarging a diameter 'd' of the circle 50 and extending the length of the arms. A ratio of the cross arm length 'c' to the diameter 'd' of the circle 50 for each set of cleats 44, 46 is about 1.6.

The arc segments 53 and the cross arms 52, 54 together define the bottom surface 56, which is substantially flat, wherein the arc segments and the arms are substantially flush with one another, i.e. there are no protrusions from the bottom surface, such that when the golf shoe is worn outside the golf course, the abrasive wear that would have resulted from such protrusions is minimized.

Figure 9:
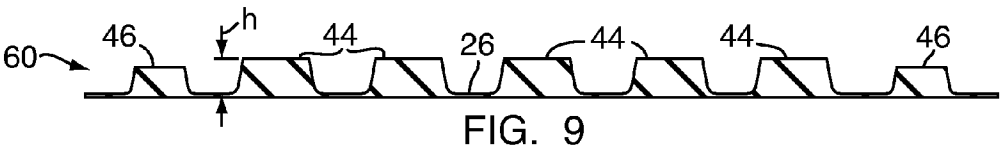
FIG. 9 is a section view of FIG. 4 taken along line 8-8 in the direction of a toe end of the shoe.

Referring back to FIG. 5, one of the diametrically opposed arms 52, 54 is aligned with one of the diametrically opposed arms 52, 54 of an adjacent cleat 44, 46 along transverse rows 60. Referring to FIG. 9, the cleats 44, 46 are substantially equally spaced along the transverse rows 60. The spacing between each of the transverse rows 60 may vary. Some transverse rows 60 may be closer together, having a distance 'a' therebetween, and some transverse rows 60 may be further apart, having a distance 'b' therebetween.

Along the longitudinal length l, each of the cleats 44, 46 is shifted in relation to the preceding and following cleats 44, 46. As a result, each cleat 44, 46 is perpendicularly offset from an adjacent cleat 44, 46 along the longitudinal length 'l'.

Referring back to FIGS. 7 and 8, the different sets of cleats 44, 46 also have different heights 'h'. The height of the larger sized cleats 44 is greater than the smaller sized cleats 46. In one embodiment, the height 'h' of the cleats 44, 46 when measured from the outer surface 26 of the outer sole 24 may be 0.079 inch (2 mm) and 0.118 inch (3 mm), respectively. These heights 'h' could be increased further up to 0.079 inch (2 mm) to improve the grip. However, there is a trade off between having greater height of the cleat to improve grip and possibility of damaging the green.

Referring back to FIG. 5, the highest cleats 44 are located along the ball area 32 of the forefoot 28 and along the heel area 36. The ball area 32 and the heel area 36 have cleats 44 with substantially the same height 'h' to provide even distribution across the outer sole 24 of any reaction forces caused by the cleats 44, 46 coming into contact with the ground. The number of cleats 44, 46 is relatively high and the cross arm length 'c' and height 'h' of the cleats 44, 46 is relatively small in comparison to the overall area of the outer surface 26.

The mid-sole 22 can be fabricated from polyurethane or any other suitable material. In a preferred embodiment, the outer sole 24 is molded from thermoplastic polyurethane (TPU). It is also contemplated that the outer sole 24 may be fabricated from rubber or polyurethane (PU) or any other suitable material.

In operation, the outer sole 24 has a relatively high number of cleats 44, 46 with relatively low heights 'h'. The relatively high number of cleats 44, 46 aids in evenly distributing any reaction forces across the outer sole 24 of the golf shoe 10. The relatively low heights 'h' of the cleats 44, 46 aid in distributing the weight of the golfer among the cleats 44, 46 and the outer surface 26 to prevent the cleats 44, 46 from excessively digging into a putting green. As the larger cleats 44 disposed in two critical areas of the shoe 10, the forefoot 28 and heel area 36, have the same height, there are no "prepressing" zones on the sole. An evenly distributed load across the golf shoe 10 allows the cleats 44, 46 to provide sufficient grip without causing an excessive amount of damage to the putting green.

One advantage of the present invention is that the plurality of cross-shaped cleats 44, 46 allows the golf shoe 10 to achieve a firm grip on a putting green. The cross-shaped cleats 44, 46 counteract a twisting torque exerted on the sole 14 during a golf swing. A large number of cross-shaped cleats 44, 46 with a relatively small height 'h' gives the golf shoe 10 an improved grip.

Another advantage of the present invention is that the outer sole 24 has no sharp internal corners or edges. The circle 50 connects the cross arms 52, 54 of the cross 48 to aid in sparing the putting green from damage by eliminating sharp internal corners or edges. The elimination of sharp internal corners also minimizes collecting mud and grass on the shoe 10 during use.

A further advantage is that the golf shoe 10 can be used as a casual shoe. The shape, size, and location of the cleats 44, 46 eliminate the need for changing into other shoes before or after a round of golf. The cleats 44, 46 act together to distribute the load evenly across the outer sole 24 and into the foot to make walking on normal streets and other surfaces possible. The golf shoe 10 can be comfortably used outside the green, as for example while driving a car.

Although the invention has been shown and described with respect to exemplary embodiments thereof, it should be understood by those skilled in the art that various changes, omissions, and additions may be made thereto, without departing from the spirit and scope of the invention. For example, although specific dimensions have been disclosed, the cross arm length 'c' and the height 'h' may be greater or less than the specific dimensions disclosed. Further, each of the larger and smaller sets of cleats 44, 46 may include more or less than the number disclosed above in each of the forefoot and heal area and in varying configurations.

What is claimed is:

1. A golf shoe having a sole comprising:

an outer surface having a longitudinal length extending from a toe end to a heel end of the sole;

a plurality of cleats integrally molded with the outer surface and extending outwardly therefrom, the plurality of cleats distributed along at least a forefoot and a heel area of the sole;

wherein the plurality of integrally molded cleats includes a first set of cleats having a larger size and a second set of cleats having a smaller size;

wherein the integrally molded cleats are arranged in transverse rows along the longitudinal length of sole, the transverse rows being parallel to one another and perpendicular to the longitudinal length; and wherein all of the cleats of at least one transverse row of integrally molded cleats in the heel area have smaller heights than all of the cleats of at least one other transverse row of integrally molded cleats in the heel area.

2. The golf shoe according to claim 1, wherein the cleats are tapered in a direction from a bottom surface towards a base surface such that the cleats form conical cylinders.

3. The golf shoe according to claim 2, wherein the cleats have a tapering of between 60 and 85 degrees with a horizontal plane.

4. The golf shoe according to claim 2, wherein a total area of the bottom surfaces of the cleats compared to an area of the outer surface is within the range of about 25% to about 40%.

5. The golf shoe according to claim 1, wherein the cleats having the smaller size substantially encircle the cleats having the larger size.

6. The golf shoe according to claim 1, wherein the forefoot of the sole has more cleats than the heel area of the sole.

7. The golf shoe according to claim 1, wherein at least one cleat is offset from an adjacent cleat along the longitudinal length.

8. The golf shoe according to claim 1, wherein the cleats of the larger sized set of cleats have greater heights than the cleats of the smaller sized set of cleats.

9. The golf shoe according to claim 1, wherein the forefoot includes a ball area and a toe area, the ball area and the heel area having cleats that are substantially equal in height.

10. The golf shoe according to claim 1, wherein the sole has a thickness of about 0.098 inch to about 0.118 inch.

11. The golf shoe according to claim 1, wherein the sole is constructed from a material selected from the group consisting of thermoplastic polyurethane and polyurethane and rubber.

12. The golf shoe according to claim 1, wherein the cleats of the plurality of cleats extend from the outer surface at heights selected from the group consisting of 0.079, 0.118, and 0.197 inch.

13. The golf shoe according to claim 1, wherein each cleat of the plurality of cleats has the shape of a conical cylinder.

14. The golf shoe according to claim 1, wherein a cleat density of the sole is between about 0.25 and 0.60.

15. A golf shoe having a sole comprising:

an outer surface extending over a toe area, a ball area, a mid-foot area, and a heel area, the outer surface having a longitudinal length extending from a toe end to a heel end of the sole;

a first plurality of cleats integrally molded with the outer surface and extending outwardly therefrom in the heel area;

a second plurality of cleats integrally molded with the outer surface and extending outwardly therefrom in the toe area and the ball area;

wherein the integrally molded cleats of the first plurality of cleats and the second plurality of cleats are conical cylinders;

wherein the integrally molded cleats of the first plurality of cleats are arranged in transverse rows along the longitudinal length of the sole, the transverse rows being parallel to one another and perpendicular to the longitudinal length; and wherein all of the cleats of at least one transverse row of integrally molded cleats in the heel area have smaller heights than all of the cleats of at least one other transverse row of integrally molded cleats in the heel area.

16. The golf shoe according to claim 15, wherein the cleats are substantially equally spaced along the transverse rows.

17. The golf shoe according to claim 15, wherein at least one cleat is perpendicularly offset from an adjacent cleat along the longitudinal length.

18. A golf shoe comprising:

a sole having an outer surface having a longitudinal length extending from a toe end to a heel end of the sole;

a plurality of cleats that are integrally molded with the outer surface and extending outwardly therefrom, the plurality of cleats distributed along at least a forefoot and a heel area of the sole;

wherein the integrally molded cleats are tapered in a direction from a bottom surface towards a base surface such that the cleats form conical cylinders; and wherein the integrally molded cleats are arranged in transverse rows along the longitudinal length of the sole, the transverse rows being parallel to one another and perpendicular to the longitudinal length, wherein all of the cleats of at least one transverse row of integrally molded cleats in the heel area have smaller heights than all of the cleats of at least one other transverse row of integrally molded cleats in the heel area.

19. The golf shoe according to claim 18, wherein the cleats have a tapering of between 60 and 85 degrees with a horizontal plane.

* * * * *